US008360726B1

(12) United States Patent
Liang

(10) Patent No.: US 8,360,726 B1
(45) Date of Patent: Jan. 29, 2013

(54) TURBINE BLADE WITH CHORDWISE COOLING CHANNELS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 739 days.

(21) Appl. No.: 12/561,992

(22) Filed: Sep. 17, 2009

(51) Int. Cl.
*F01D 5/18* (2006.01)
*F01D 5/08* (2006.01)

(52) U.S. Cl. ..... 416/97 R; 416/96 R; 416/241 R

(58) Field of Classification Search ..... 415/115; 416/96 R, 96 A, 97 R, 241 R, 241 B; 165/908
See application file for complete search history.

(56) References Cited

U.S. PATENT DOCUMENTS 3,574,481 A * 4/1971 Pyne et al. ..... 416/90 R
5,702,232 A 12/1997 Moore
6,910,864 B2 6/2005 Tomberg
2006/0171809 A1 * 8/2006 Albrecht et al. ..... 416/97 R
2008/0050243 A1 * 2/2008 Liang ..... 416/97 R

FOREIGN PATENT DOCUMENTS

GB 2127105 A * 4/1984

* cited by examiner

*Primary Examiner* — Christopher Verdier
*Assistant Examiner* — Jason Davis
(74) *Attorney, Agent, or Firm* — John Ryznic

(57) ABSTRACT

A turbine rotor blade with near wall cooling that provides full coverage film cooling for the leading and trailing edges. A first layer of chordwise extending cooling channels are formed on a spar, and a second layer of chordwise extending cooling channels are formed over the first layer to provide near wall cooling. Open ends of the two layers of channels on both pressure and suction side walls of the blade open into a leading edge slot and the trailing edge wall sides to discharge film cooling air.

10 Claims, 5 Drawing Sheets

TURBINE BLADE WITH CHORDWISE COOLING CHANNELS

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine rotor blade.

2. Description of the Related Art Including Information Disclosed Under 37 CFR 1.97 and 1.98

A gas turbine engine includes a turbine with rotor blades and stator blades that are exposed to a hot gas flow in order to convert combustion energy into mechanical energy. The turbine efficiency, and therefore the engine efficiency, can be increased by passing a higher temperature gas flow through the turbine, referred to as the turbine inlet temperature. The highest turbine inlet temperature is limited to both the material properties of the airfoils (both blades and vanes have airfoils) and the amount of cooling that can be produced in these airfoils.

FIG. 1 shows a prior art turbine rotor blade of U.S. Pat. No. 5,702,232 issued to Moore on Dec. 30, 1997 and entitled COOLED AIRFOILS FOR A GAS TURBINE ENGINE. This blade uses near wall cooling in the airfoil mid-chord section that is constructed with radial flow channels plus resupply holes in conjunction with film discharge cooling holes. In this design, the spanwise and chordwise cooling air flow control due to airfoil external hot gas temperature and pressure variation is difficult to achieve. In addition, a single radial flow channel is not the best method of utilizing cooling air because this results in a low convective cooling effectiveness. Also, the dimension for the airfoil external wall has to meet the investment casting requirements.

BRIEF SUMMARY OF THE INVENTION

It is an object of the present invention to provide for a turbine rotor blade with a near wall full coverage film cooling design.

It is another object of the present invention to provide for a turbine rotor blade with a leading edge having a full layer of film cooling air from the all along the airfoil leading edge.

It is another object of the present invention to provide for a turbine rotor blade with a much reduced airfoil edge metal temperature than the prior art turbine rotor blade cooling design.

It is an object of the present invention to provide for a turbine rotor blade with a cooling flow circuit that can be individually adjusted based on the airfoil local external heat load to achieve a desired local metal temperature.

It is an object of the present invention to provide for a turbine rotor blade with a cooling flow circuit that will maximize the usage of cooling air for a given airfoil inlet gas temperature and pressure profile.

It is an object of the present invention to provide for a turbine rotor blade with a cooling flow circuit with a higher internal convection cooling effectiveness than the single pass radial flow cooling channels of the cited prior art blade cooling circuit.

The above objective and more are achieved with the cooling circuit for a turbine rotor blade of the present invention in which the blade includes a main spar that defines a cooling supply cavity on the inside and a plurality of chordwise extending cooling air channels on the outside surface that extend from the leading edge to the trailing edge of the blade. An intermediate piece is bonded to the outer surface of the spar to form a first layer of chordwise extending cooling channels, and this first layer also has an outer surface that forms a plurality of chordwise extending cooling air channels from the leading edge to the trailing edge. A thin thermal skin is bonded to the outer surface of the intermediate piece to form a second layer of chordwise extending cooling air channels.

The first and second layers of chordwise cooling channels open into a leading edge discharge open slot formed at the leading edge and into discharge slots formed on the pressure side wall and suction side wall of the trailing edge of the blade. Cooling air from the supply cavity is delivered to the first and second layers of chordwise channels through feed holes formed in the spar and the intermediate layer.

DETAILED DESCRIPTION OF THE INVENTION

Figure 1:
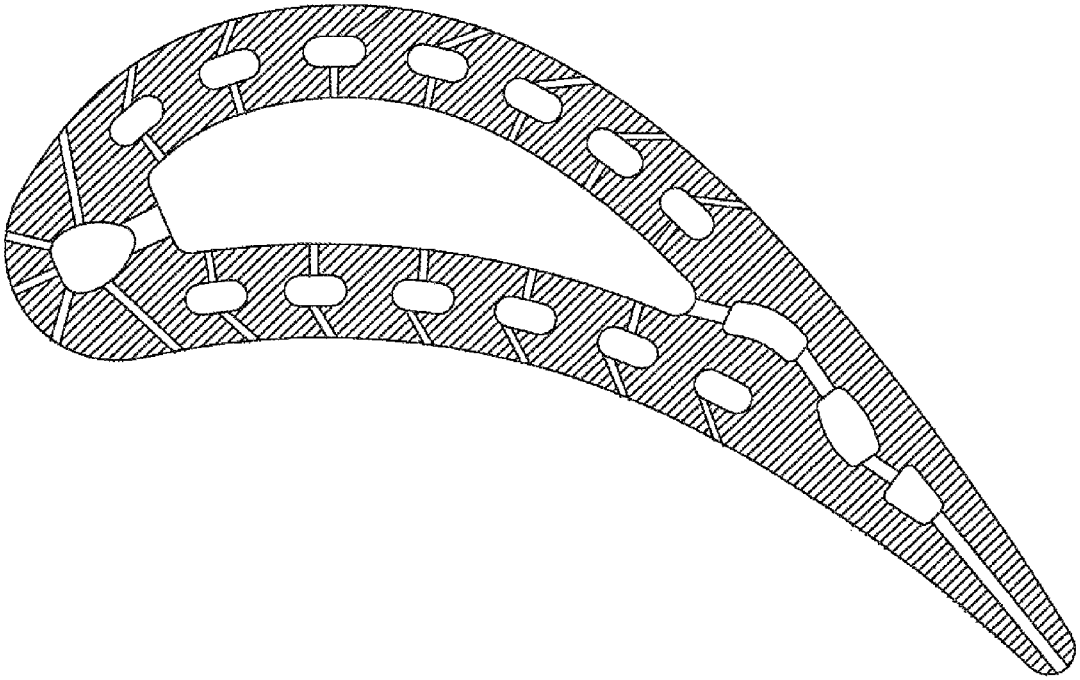
Fig 1 Prior Art
FIG. 1 shows a turbine rotor blade of the prior art with radial cooling channels formed within the airfoil walls.
Figure 2:
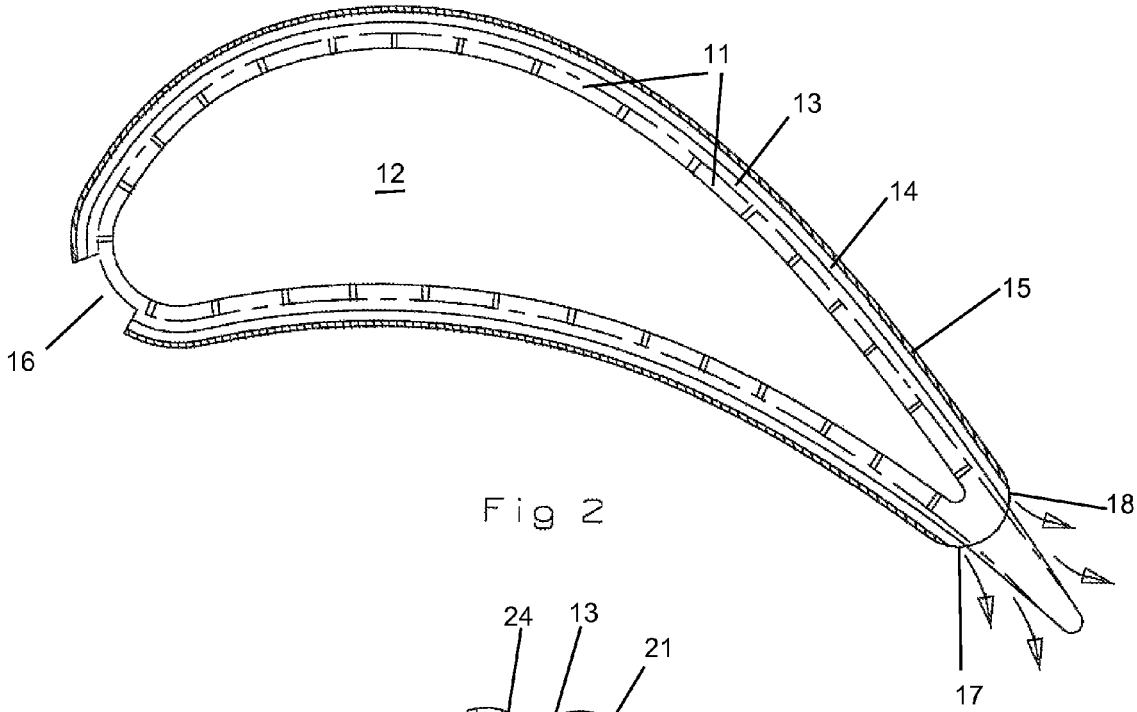
FIG. 2 shows a cross section cut-away view of the blade of the present invention.

The cooling circuit of the present invention is disclosed for use in a turbine rotor blade, but can also be used in stator vanes. FIG. 2 shows the blade with a main spar 11 that defines the general airfoil shape of the blade and forms the main support surface for the thin thermal skin that forms the airfoil surface. The main spar 11 also forms an internal cooling air supply cavity 12. On an outer surface of the main spar 11 is formed a number of chordwise extending channels 13 that extend from the leading edge region to the trailing edge region all along the spanwise direction of the airfoil section of the blade from the platform to the tip. These form a first layer of chordwise extending cooling channels for the blade. Outside of the first layer of chordwise extending cooling channels is a second layer of chordwise extending cooling channels 14 that also extend from the leading edge region to the trailing edge region and all along the airfoil surface from platform to blade tip. The second layer of chordwise cooling channels is formed over the first layer of chordwise cooling channels.

Figure 3:
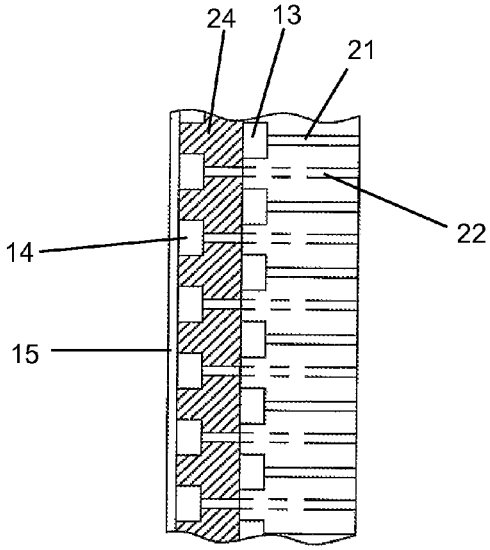
FIG. 3 shows a side view through a section of the airfoil wall of the blade of the present invention.

FIG. 3 shows a better view of the structure of the airfoil wall. The main spar 11 forms the cooling supply cavity 12 on the right side surface of this figure, and forms the chordwise extending channels 13 on the left side surface. An intermediate layer 24 of material is bonded to the outer surface of the main spar 11 to enclose the first layer of chordwise cooling channels 13. The outer surface of the intermediate layer 24 also includes chordwise extending channels 14 that are enclosed by a thin thermal skin 15 bonded to the intermediate layer 24. The first layer of chordwise cooling channels 13 is connected to the cooling supply cavity through first layer cooling holes 21 and the second layer of chordwise cooling channels 14 is connected through second layer cooling holes 22 both formed within the main spar by drilling after the main spar is cast.

The main support spar can be cast with the cooling supply cavity using the investment casting process. The first layer of chordwise extending cooling channels 13 can be cast during the casting process or machined into the main spar 11 after casting the main spar 11. The intermediate layer 24 and the thin thermal skin 15 can be of a different material form the spar 11 or of the same material and is bonded to the surface within using transient liquid phase (TLP) bonding process. The intermediate layer and the thin thermal skin layer can each be in multiple pieces or a single piece and can be formed of a high temperature material in a thin sheet metal form. A thickness of the thermal skin can be in a range of 0.01 inches to 0.030 inches while the intermediate layer 24 can be twice the height of the first layer channels 13. These channel heights and layers thicknesses would be very difficult to achieve in the prior art lost wax investment casting process.

Figure 4:
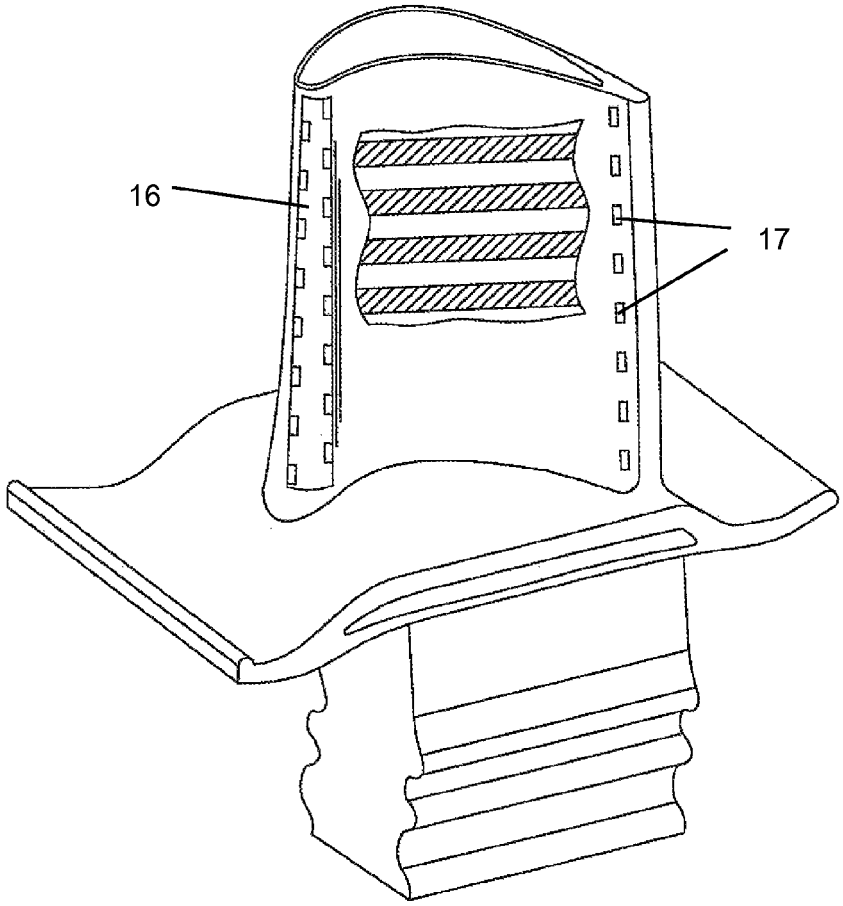
FIG. 4 shows an isometric view of the blade of the present invention with a portion of the airfoil skin removed to show the chordwise extending cooling channels.

FIG. 4 shows the blade with a section on the pressure side wall removed so that the chordwise channels separated by chordwise ribs are shown. The leading edge flow channel 16 is formed in the leading edge of the blade, and a row of trailing edge discharge slots 17 is shown on the pressure side wall.

Figure 5:
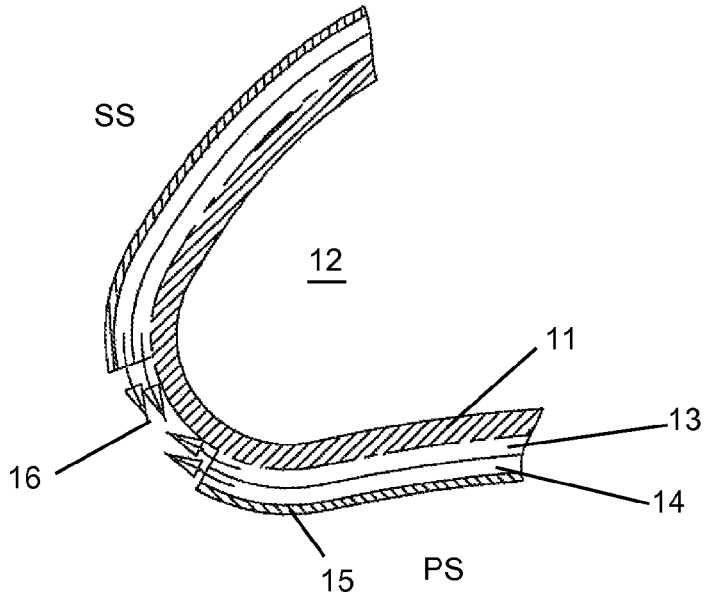
FIG. 5 shows a cross section top view of the leading edge portion of the cooling circuit of the present invention.
Figure 6:
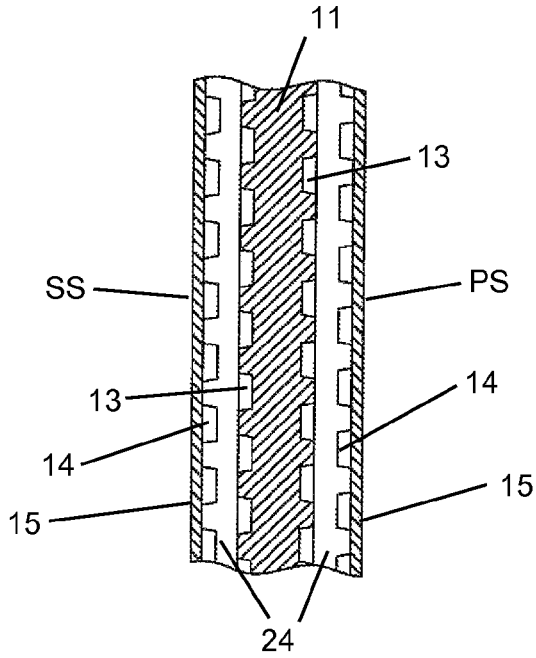
FIG. 6 shows a front view of the leading edge cooling circuit of the present invention.

FIGS. 5 and 6 show the construction of the leading edge slot 16. The first and second layers of chordwise channels 13 and 14 end at the leading edge region and form the leading edge flow channel 16. Both the first and second layers of chordwise channels 13 and 14 on the pressure side wall and the suction side wall discharge into the leading edge flow channel 16. FIG. 6 shows a front view of the leading edge flow channel 16 with the main spar 11 having forming the first layer of channels 13 with the intermediate layer 24, and the second layer of channels 14 formed by the thermal skin 15 that both open into the flow channel 16 from the P/S wall and the S/S wall.

Figure 7:
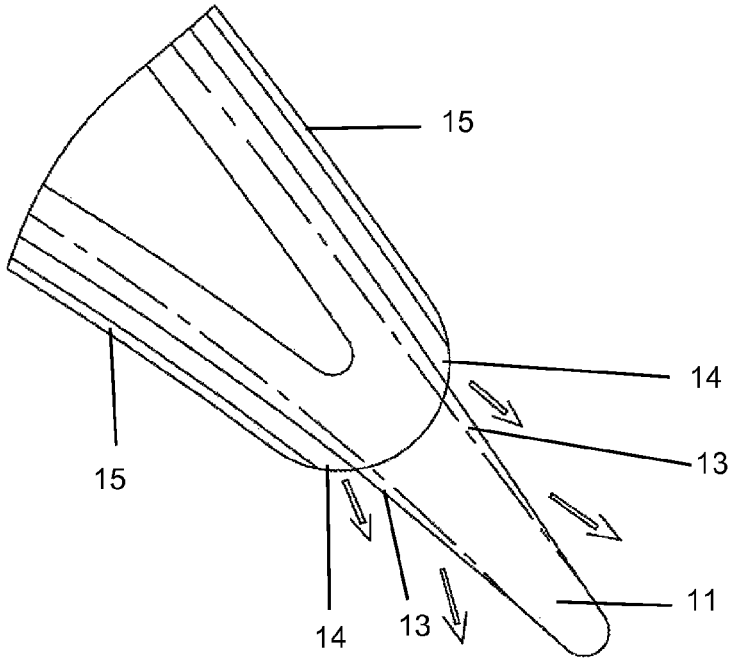
FIG. 7 shows a cross section cut-away view of the trailing edge cooling circuit of the present invention.

FIG. 7 shows a cross section top view of the trailing edge cooling channels of the present invention with the first layer channels 13 and the second layer channels 14 opening onto both side walls of the T/E through slots. The spar 11 is solid in this region and extends out from the channels to form the trailing edge of the blade. The first and second layers of channels 13 and 14 on the pressure side both open into the row of slots 17 on the pressure side wall of the T/E, and the first and second layers of channels 13 and 14 on the suction side both open into the row of slots 18 on the suction side wall of the T/E.

The multiple layers of cooling channels are constructed in chordwise parallel forward flowing and aft flowing directions. Individual chordwise multiple flow channels are designed based on the airfoil gas side pressure distribution in both chordwise and spanwise directions. In addition, each individual channel can be designed based on the airfoil local external heat load to achieve a desired local metal temperature. With this new design, a maximum use of the cooling air for a given airfoil inlet temperature and pressure profile is achieved. Also, the multiple layers of cooling channels in the chordwise direction yields a higher internal convection cooling effectiveness than the single radial flow channels of the prior art blade.

In operation, cooling air is supplied through the airfoil cooling supply cavity 12 located in the blade mid-chord section. Cooling air is then channeled through each individual chordwise extending channel in the first and second layers. The chordwise cooling channels are arranged in a staggered formation in-between the first and second layers. In addition, pressure side flow channels are also staggered with respect to the suction side flow channels. Cooling air is channeled toward the airfoil leading edge and the trailing edge. Spent cooling air is then discharged at the blade leading edge into the flow channel 16 and out the T/E slots on the pressure and suction side walls for a full coverage film cooling on both L/E and T/E sides of the blade.

For the airfoil L/E region, the channels in the first and second layers both discharge cooling air from the pressure and suction sides into an open continuous slot or flow channel 16. Since the first and second layers of channels are staggered as seen in FIG. 6, the spent discharged cooling air will fully cover the entire continuous flow channel formed in the leading edge. A full overage film cooled airfoil leading edge cooling is thus achieved.

In the trailing edge region, the spent cooling air is discharged from the two layers of channels through a double row of trailing edge pressure side exit slots for the cooling of the trailing edge corner prior to being discharged from the airfoil. A similar arrangement is used on the airfoil suction side trailing edge corner. This combined effect for this cooling discharge arrangement provides for a full coverage film on the airfoil T/E. also, this cooling design creates a pair of submerged cooling channels for the airfoil pressure side and suction side. As the cooling flow exits from the submerged cooling channels at a mainstream interface location, it forms a concurrent flow with the mainstream flow to thus minimize shear mixing between the cooling air flow and the mainstream flow which therefore will enhance the cooling effectiveness for the airfoil trailing edge. And, the wrapped around cooling channels also reduce the effective T/E thickness and thus reduce the blade blockage loss.

I claim the following:

1. A turbine rotor blade comprising:

a main spar forming a cooling supply cavity on an inner surface and a first row of chordwise extending cooling channels on an outer surface;

an intermediate layer bonded to the outer surface of the main spar to enclose the first row of channels to form a first layer of chordwise extending cooling channels;

the intermediate layer having an outer surface with a second row of chordwise extending cooling channels; and, a thin thermal skin bonded to the intermediate layer to form a second layer of chordwise extending cooling channels over the first layer of chordwise extending cooling channels.

2. The turbine rotor blade of claim 1, and further comprising:

each of the cooling channels in the first and second layers is connected to the cooling supply cavity by a cooling air separate feed hole.

3. The turbine rotor blade of claim 1, and further comprising:

the second layer of chordwise channels is staggered over the first layer of chordwise channels.

4. The turbine rotor blade of claim 1, and further comprising:

a thickness of the intermediate layer is around two times a height of the first layer of chordwise channels.

5. The turbine rotor blade of claim 4, and further comprising:

a thickness of the thin thermal skin is around 0.010 to 0.030 inches.

6. The turbine rotor blade of claim 5, and further comprising:

the first and second layers of channels are each individually sized based on an airfoil local external heat load to achieve a desired local metal temperature.

7. The turbine rotor blade of claim 1, and further comprising:

the first and second layers of chordwise cooling channels are formed on both the pressure side and suction side walls of the blade; and, the first and second layers of chordwise cooling channels on both the pressure and suction sides of the blade end in a leading edge region to form a leading edge open flow channel that extends a spanwise length of the airfoil.

8. The turbine rotor blade of claim 7, and further comprising:

the first and second layers of chordwise channels on the pressure side wall are staggered with respect to the first and second layers of chordwise channels on the suction side wall at the leading edge open flow channel.

9. The turbine rotor blade of claim 1, and further comprising:

the first and second layers of chordwise cooling channels are formed on both the pressure side and suction side walls of the blade;

the first and second layers of chordwise channels on the pressure side both open into a row of trailing edge slots on the pressure side wall; and, the first and second layers of chordwise channels on the suction side both open into a row of trailing edge slots on the suction side wall.

10. The turbine rotor blade of claim 1, and further comprising:

the first and second layers of chordwise channels both open into a leading edge slot and a trailing edge slot.

* * * * *